US010099083B1

(12) United States Patent
Owusu

(10) Patent No.: US 10,099,083 B1
(45) Date of Patent: Oct. 16, 2018

(54) EXERCISE DEVICES, SYSTEMS, AND METHODS

(71) Applicant: JAXAMO LTD, Bedfordshire (GB)

(72) Inventor: Stephen Owusu, Newcastle, WA (US)

(73) Assignee: Jaxamo Ltd, Bedfordshire (GB)

( * ) Notice: Subject to any disclaimer, the term of this patent is extended or adjusted under 35 U.S.C. 154(b) by 0 days.

(21) Appl. No.: 15/887,278

(22) Filed: Feb. 2, 2018

(51) Int. Cl.

| | |
|---|---|
| ***A63B 71/06*** | (2006.01) |
| ***A63B 21/075*** | (2006.01) |
| ***A63B 24/00*** | (2006.01) |
| ***A63B 71/00*** | (2006.01) |
| ***A63B 21/00*** | (2006.01) |
| ***A63B 23/12*** | (2006.01) |

(52) U.S. Cl.
CPC ..... *A63B 21/075* (2013.01); *A63B 21/4035* (2015.10); *A63B 23/12* (2013.01); *A63B 24/0062* (2013.01); *A63B 24/0087* (2013.01); *A63B 71/0054* (2013.01); *A63B 71/0619* (2013.01); *A63B 2024/0081* (2013.01); *A63B 2225/50* (2013.01)

(58) Field of Classification Search
CPC ..... A63B 2024/0081; A63B 21/075; A63B 21/4035; A63B 23/12; A63B 71/0619; A63B 71/0054; A63B 24/0062; A63B 24/0087; A63B 2225/50; A63B 21/00; A63B 21/00058; A63B 21/00065; A63B 21/06; A63B 21/0605; A63B 21/072; A63B 21/0728
See application file for complete search history.

(56) References Cited

U.S. PATENT DOCUMENTS

| | | | | |
|---|---|---|---|---|
| 6,540,650 | B1 | 4/2003 | Krull | |
| 6,746,381 | B2 | 6/2004 | Krull | |
| 7,614,983 | B1 | 11/2009 | Krull | |
| 7,762,933 | B1 * | 7/2010 | Yu | A63B 21/075 482/106 |
| 7,976,443 | B2 | 7/2011 | Krull | |
| 7,981,012 | B1 | 7/2011 | Krull | |
| 7,981,013 | B2 | 7/2011 | Krull | |
| 8,021,282 | B2 | 9/2011 | Polevoy et al. | |
| 8,771,153 | B2 | 7/2014 | Dalebout et al. | |
| 8,784,280 | B2 | 7/2014 | Krull | |
| 2015/0273272 | A1 * | 10/2015 | Wang | A63B 24/0087 700/91 |
| 2015/0360073 | A1 * | 12/2015 | Moran | A63B 21/075 482/107 |

(Continued)

*Primary Examiner* — Loan H Thanh
*Assistant Examiner* — Megan Anderson
(74) *Attorney, Agent, or Firm* — RatnerPrestia

(57) ABSTRACT

Exercise devices, systems, and methods are disclosed. One exercise device includes weights, a shell assembly, and a base assembly. The shell assembly has a shell defining an interior sized to receive the weights. The shell assembly also has a shaft coupled for rotation relative to the shell. When the weights are received within the interior of the shell, rotation of the shaft relative to the shell selectively couples the shaft with one or more weights. The base assembly has a base configured to support the weights. The base assembly also has a driver configured to be coupled to the shaft when the shell assembly is supported by the base. The driver of the base assembly is configured to rotate the shaft relative to the shell when the driver is coupled to the shaft to selectively couple the shaft with the one or more weights.

29 Claims, 12 Drawing Sheets

(56) References Cited

U.S. PATENT DOCUMENTS

2016/0089575 A1* 3/2016 Smith ..... H04M 1/72533
482/5
2018/0036578 A1* 2/2018 Moran ..... A63B 21/075

* cited by examiner

EXERCISE DEVICES, SYSTEMS, AND METHODS

FIELD OF THE INVENTION

The present invention relates generally to weight training exercise, and more particularly, to adjustable weight exercise devices, systems, and methods.

BACKGROUND OF THE INVENTION

Conventionally, weight training exercises may be performed with free weight devices, such as dumbbells, kettlebells, or the like. These free weight devices may have a fixed weight, or may allow a user to adjust their weight through the manual addition or removal of weights.

Adjusting the weight on a free weight device may interfere with weight training by causing a substantial pause in or disruption to the user's desired training activity. Accordingly, improved devices, systems, and methods are desired for adjusting the weight of exercise equipment.

SUMMARY OF THE INVENTION

Aspects of the present invention are related to exercise devices, systems, and methods.

In accordance with one aspect of the present invention, an exercise device includes a plurality of weights, a shell assembly, and a base assembly. The weights are configured to be positioned adjacent one another. The shell assembly has a shell defining an interior sized to receive the weights. The shell assembly also has a shaft coupled for rotation relative to the shell and extending within the interior of the shell. When the weights are received within the interior of the shell, rotation of the shaft relative to the shell selectively couples the shaft with one or more of the weights. The base assembly has a base configured to support the weights and the shell assembly. The base assembly also has a driver configured to be coupled to the shaft of the shell assembly when the shell assembly is supported by the base. The driver is also configured to be decoupled from the shaft of the shell assembly when the shell assembly is not supported by the base. The driver of the base assembly is configured to rotate the shaft of the shell assembly relative to the shell of the shell assembly when the driver is coupled to the shaft of the shell assembly to selectively couple the shaft with the one or more of the weights.

In accordance with another aspect of the present invention, an exercise method includes positioning a shell assembly on a base assembly having a plurality of weights positioned on it, such that the weights are received within an interior of a shell of the shell assembly; rotating a shaft of the shell assembly relative to the shell with a driver of the base assembly coupled to the shaft to selectively couple the shaft with one or more of the weights; and lifting the shell assembly off of the base assembly with the one or more of the weights coupled with the shaft of the shell assembly and with the one or more of the weights within the interior of the shell.

In accordance with yet another aspect of the present invention, an exercise system includes a plurality of exercise devices. Each exercise device has a plurality of weights configured to be positioned adjacent one another, a shaft configured for rotation relative to the weights, wherein rotation of the shaft relative to the weights selectively couples the shaft with one or more of the weights, a base assembly having a base configured to support the weights and a driver configured to be coupled to and decoupled from the shaft, and a communication device configured to wirelessly communicate with the communication device of another one of the exercise devices. The driver of one of the exercise devices is configured to rotate the shaft of the one of the exercise devices based on data received from the communication device of another one of the exercise devices.

In accordance with still another aspect of the present invention, an exercise device includes a plurality of weights, a shaft, a base assembly, and an input device. The weights are configured to be positioned adjacent one another. The shaft is configured to engage with one or more of the weights. The base assembly has a driver configured to be coupled to and decoupled from the shaft. The input device is associated with the shaft or the base assembly. The input device is configured to receive an input from a user of the exercise device. The input includes a selection of a number of the weights. The driver of the base assembly is configured to automatically move the shaft relative to the weights when the driver is coupled to the shaft and when the input is received by the input device to selectively engage the shaft with the selected number of weights.

BRIEF DESCRIPTION OF THE DRAWINGS

The invention is best understood from the following detailed description when read in connection with the accompanying drawings. When a plurality of similar elements are present, a single reference numeral may be assigned to the plurality of similar elements with a small letter designation referring to specific elements. When referring to the elements collectively or to a non-specific one or more of the elements, the small letter designation may be dropped. It is emphasized that, according to common practice, the various features of the drawings are not necessarily to scale. On the contrary, the dimensions of the various features may be arbitrarily expanded or reduced for clarity. Included in the drawings are the following figures.

DETAILED DESCRIPTION OF THE INVENTION

Figure 1A:
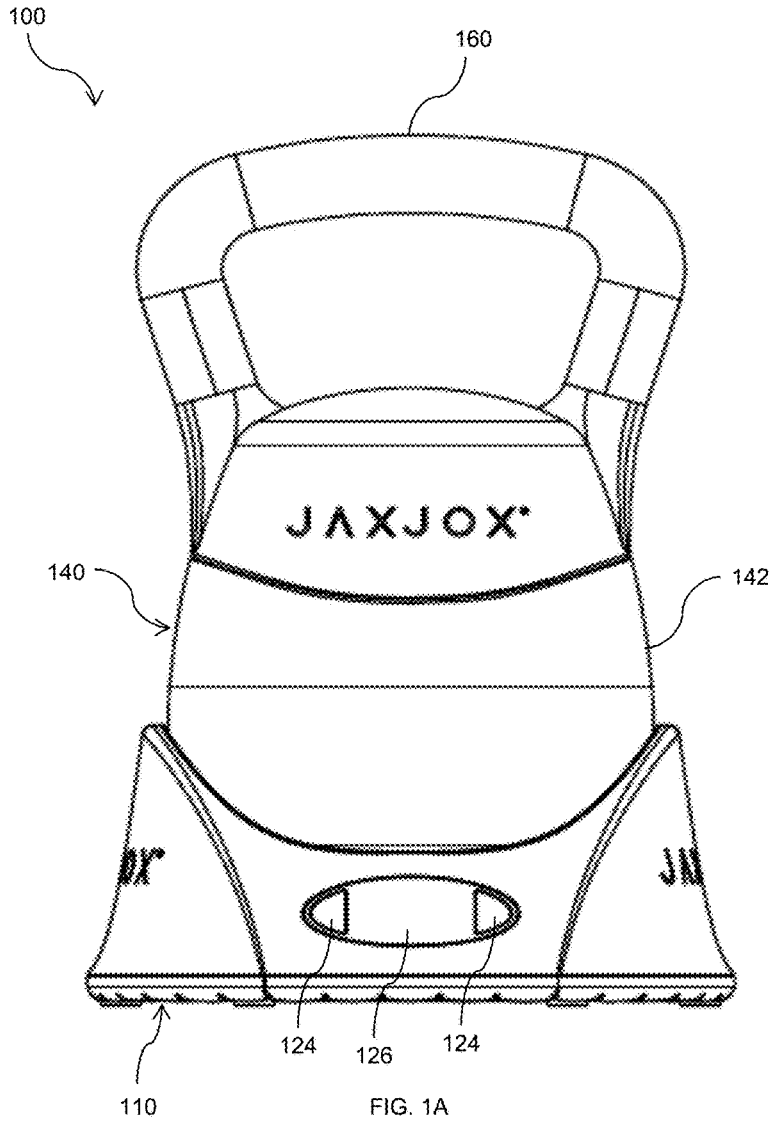
FIGS. 1A-1C depict an exemplary exercise device in accordance with aspects of the present invention.

Although the invention is illustrated and described herein with reference to specific embodiments, the invention is not intended to be limited to the details shown. Rather, various modifications may be made in the details within the scope and range of equivalents of the claims and without departing from the invention.

The exemplary exercise systems, methods, and devices disclosed herein are principally described with respect to kettlebells. However, it will be understood by one of ordinary skill in the art that the invention is not so limited. To the contrary, the disclosed concepts, features, and embodiments may be usable with any type of weight device without departing from the spirit or scope of the present invention, including, for example, dumbbells, barbells, medicine balls, or other free weights and weight systems.

The exemplary systems, devices, and methods disclosed herein may be usable by an individual user as part of one or a series of weight training exercises. In such uses, the disclosed embodiments may allow the individual user to select a desired weight for the weight training exercise, and/or adjust the weight of the exercise device before, during, or after a weight training exercise.

Additionally, the exemplary systems, devices, and methods disclosed herein may be usable by groups of users as part of a coordinated weight training exercise. Such groups of users may be co-located at a single location or remotely located and connected by technology in a virtual group. In such use, whether the users are co-located or in a virtual group, the disclosed embodiments may allow an individual user in the group to select a desired weight for the weight training exercise, and automatically communicate that desired weight to the exercise systems or devices of other individuals in the group. The desired weight may further be automatically selected at the exercise systems or devices of one or more of the individuals in the group.

Alternatively, the exemplary systems, devices, and methods disclosed herein may be usable by an individual user alone without connection to other systems or devices. Accordingly, the usage of the systems, devices, and methods is scalable.

Referring now to the drawings, FIGS. 1A-1C, 2A, and 2B illustrate an exemplary exercise device or apparatus 100 in accordance with aspects of the present invention. Exercise device 100 may be, for example, provided in the form of a kettlebell. As a general overview, device 100 includes a base assembly 110, a shell assembly 140, and a plurality of weights 170. Additional details of device 100 are described below.

Base assembly 110 provides support for the components of device 100. Base assembly 110 has a housing 112 which houses certain components of device 100. Housing 112 may include one or more exterior surfaces on which other components of device 100 may rest.

As shown in FIGS. 2A, 2B, 3A and 3B, housing 112 of base assembly 110 may include a first surface 114 and a second surface 116 on an upper portion thereof. Surfaces 114 and 116 form a base configured to support shell assembly 140 and weights 170. In particular, surface 114 may be configured to support weights 170, e.g., in a stacked orientation, and surface 116 may be configured to support shell assembly 140, e.g., at a lower surface thereof. In this example, surface 116 surrounds first surface 114. Surface 116 may be formed at a same level as surface 114, or may be provided at a level above or below the level of surface 114.

Base assembly 110 may further include one or more guide walls 118 and guide projections 119. Guide walls 118 extend upward from surface 116 to assist the user of device 100 in aligning shell assembly 140 on base assembly 110. Guide projections 119 extend upward from surface 114 to assist the user of device 100 in aligning weights 170 on base assembly 110.

Base assembly 110 houses a driver 120. Driver 120 is configured to be coupled to and decoupled from a shaft 150 of shell assembly 140, as will be described in greater detail below. Driver 120 is further configured to move, e.g. rotate, the shaft 150 of shell assembly 140. In an exemplary embodiment, driver 120 comprises a motor, such as a brushless electric motor. Suitable motors for use as driver 120 will be known from the description herein.

Base assembly 110 may further comprise a controller 122. Controller 122 electrically controls driver 120 to operate, e.g., to rotate, shaft 150 when shaft 150 is coupled to driver 120. As will be discussed in greater detail below, controller 122 may operate driver 120 automatically, or in response to some input, e.g., input from a user of exercise device 100 or a transmission from another exercise device 100.

Controller 122 may be in communication with a sensor 123. Sensor 123 is configured to detect when driver 120 is coupled to or decoupled from shaft 150 of shell assembly 140. Controller 122 may thus operate driver 120 only when sensor 123 signals that driver 120 is coupled to shaft 150 or that one or more surfaces of the base assembly 110, such as surfaces 114 and/or 116, support or are adjacent to the shell assembly 140 and/or weights 170. Suitable sensors for use as sensor 123 include, for example, optical sensors, pressure sensors, or electrical sensors.

Base assembly 110 may further comprise an input device 124. Input device 124 receives input from a user of exercise device 100. Input device 124 is electrically and/or mechanically coupled to driver 120 to cause driver 120 to rotate shaft 150 based on input by the user of exercise device 100. The input may comprise a selection of a type of weight training exercise, an amount of weight, or a number of weights 170. Controller 122 may then control driver 120 based on the type of weight training exercise, an amount of weight, or a number of weights 170 received by input device 124.

The form of input device 124 is not intended to be limited. Input device 124 may be configured to receive a mechanical input, e.g., a knob, dial, button, slider, or other structure, adapted to be directly manipulated or moved by the user of exercise device 100. Input device 124 may be configured to receive an electrical or electronic input, e.g., a key, touchscreen, or touchpad, or other structure, adapted to generate a mechanical signal in response to a user interaction. Other structures suitable for use as input device 124 will be known from the description herein.

Along with input device 124, base assembly 110 may further comprise a display 126. Display 126 is configured to display the input provided by the user to input device 124, e.g., the selected exercise, amount of weight, or selected number of weights 170. Suitable displays for use as display 126 include, for example, liquid crystal displays or light emitting diode displays. Other displays will be known from the description herein.

Base assembly 110 may further comprise a communication device 128. Communication device 128 may be configured to wirelessly communicate with another exercise device 100, and/or with other wireless transceivers, as discussed in greater detail below. Data received via communication device 128 may be used to control the operation of driver 120, as described in greater detail below.

While input device 124 and display 126 are described as being associated with and/or housed by base assembly 110, it will be understood that the invention is not so limited. For example, sensor 123, input device 124, and/or display 126 may be provided on shell assembly 140. In one embodiment, sensor 123, input device 124, and display 126 are provided on an exterior surface of shell 142. In this embodiment, sensor 123 and/or input device 124 may communicate the user input to the driver 120 in base assembly 110 by wireless communication, or by way of a wired communication interface which is created when shell assembly 140 is placed on base assembly 110. Where sensor 123 is provided on the exterior surface of shell 142, sensor 123 may be provided with a sensor cover 129 to protect sensor 123 from an external environment.

Alternatively, device 100 may not include a display 126. In such embodiments, the information to be presented by display 126 may be presented with a remote device (e.g., on a smartphone or tablet display or monitor of the user) which is in wired or wireless communication with device 100.

A power supply 130 (such as a rechargeable battery) may be provided in base assembly 110 or shell assembly 140 for powering the electrical components of device 100. Alternatively, device 100 may be provided with power through one or more power/communication terminals 132 formed on base assembly 110 or via a port or cable connection. Device 100 may be configured to be primarily powered through terminals 132, or may use power connections through terminals 132 for recharging power supply, e.g., when power supply 130 is a rechargeable battery. Other sources of power can optionally be selected as well.

Figure 1B:
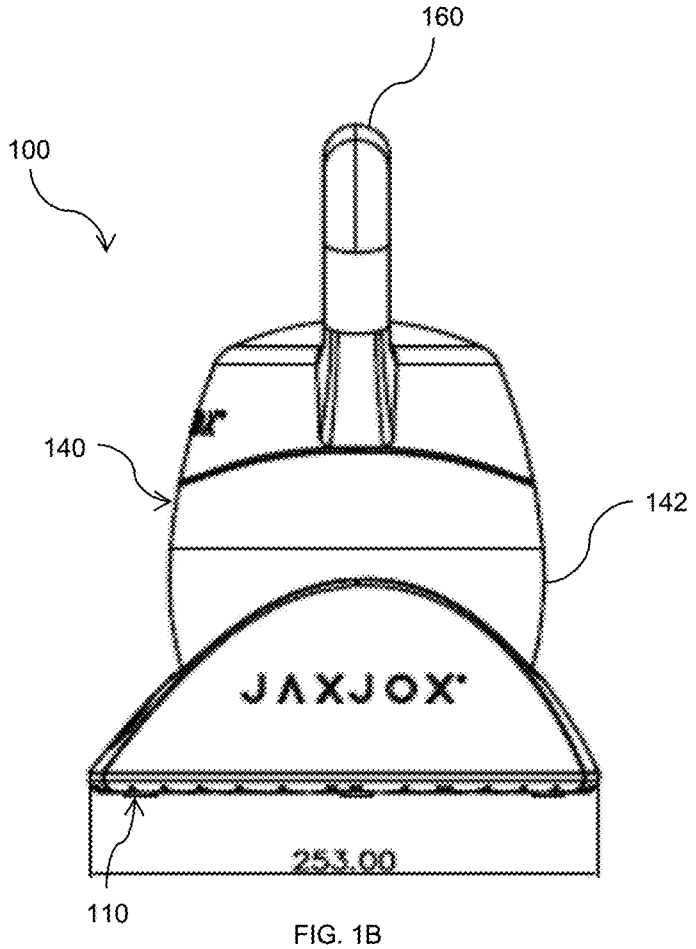
Figure 1C:
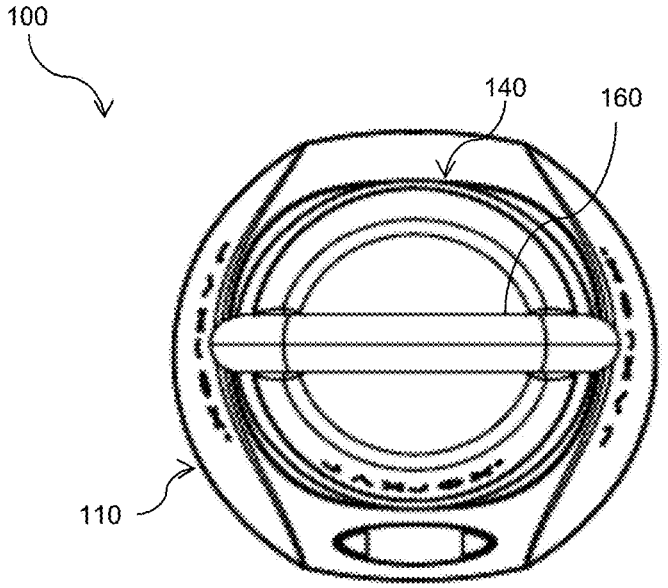

Shell assembly 140 is grasped and lifted by a user of device 100. As shown in FIGS. 1A-1C, shell assembly 140 may have the shape of a kettlebell. However, it will be understood that the shape of shell assembly 140 is not limited, and shell assembly 140 may be configured as any type of free weight device.

Figure 2A:
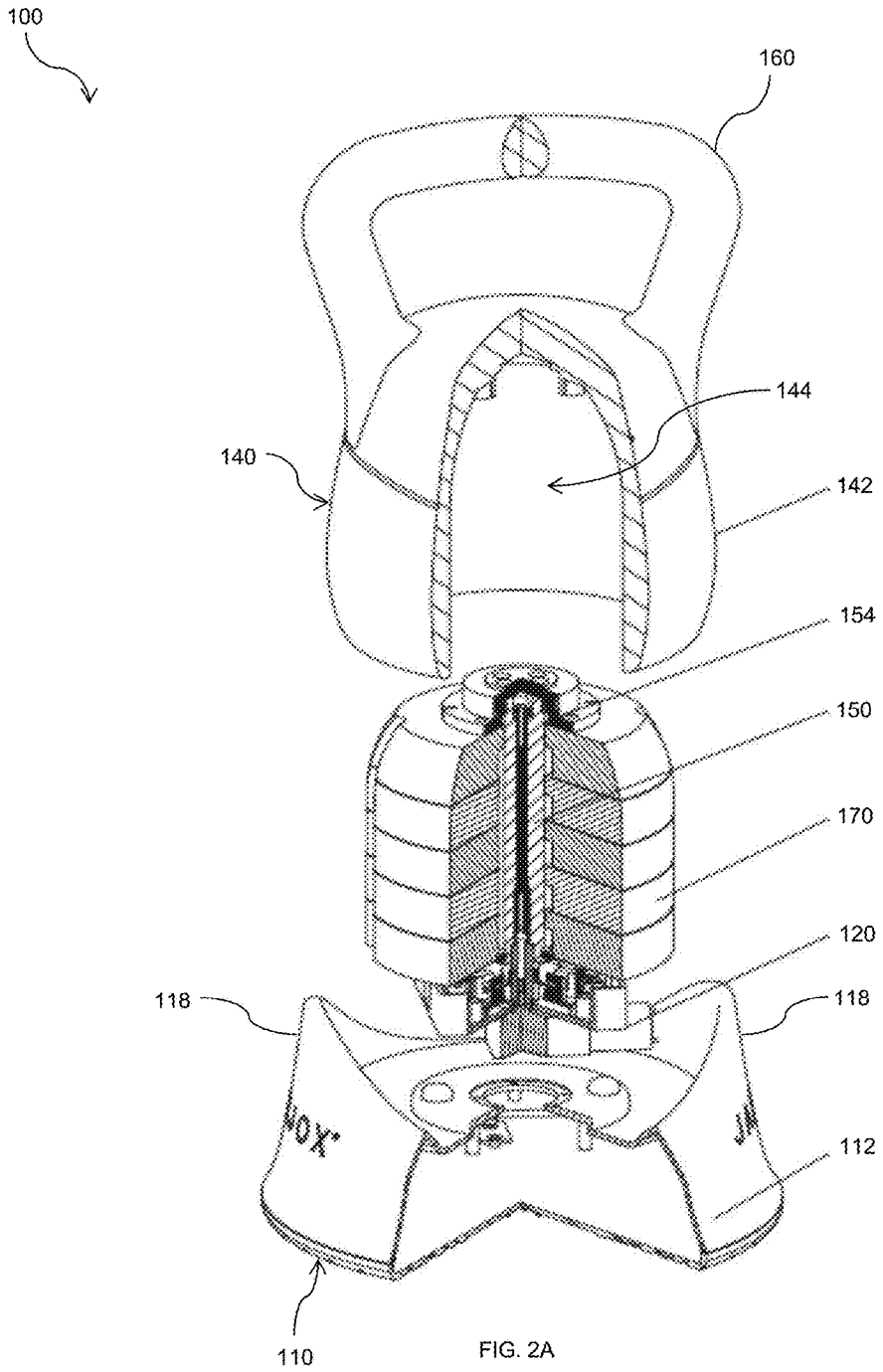
FIGS. 2A and 2B depict exploded views of the exercise device of FIGS. 1A-1C.

As shown in FIGS. 2A, 2B, and 4A-4C, shell assembly 140 includes a shell 142. Shell 142 defines an interior space 144, which is sized to receive weights 170. Shell 142 and interior space 144 have a shape and size selected to correspond to the shape and size of weights 170. For example, shell 142 and interior space 144 may have a generally circular cross-section, as shown in FIG. 2A, or any other shape to match that of a shell or support that may not have a circular cross-section. Interior space 144 of shell 142 may further include one or more ridges 146. Ridges 146 may be used to align weights 170 in space 144, and may be used to prevent rotation of weight 170 within space 144.

Shell assembly 140 further includes shaft 150. Shaft 150 extends within the interior space 144 of shell 142. Shaft 150 may be coupled for rotation relative to the other components of shell assembly, such as shell 142. As will be described in greater detail below, rotation of shaft 150 when weights 170 are received within interior space 144 may couple shaft 150 with one or more of weight 170.

Shaft 150 is configured to be coupled to driver 120 when shell assembly 140 is supported on base assembly 110. Shaft 150 is also configured to be decoupled from driver 120 when shell assembly 140 is removed from base assembly 110, e.g., when a user lifts shell assembly 140 off of base assembly 110 during a weight training exercise. Shaft 150 includes projections 152 for engaging with corresponding structures on weights 170, as described in greater detail below.

Figure 2B:
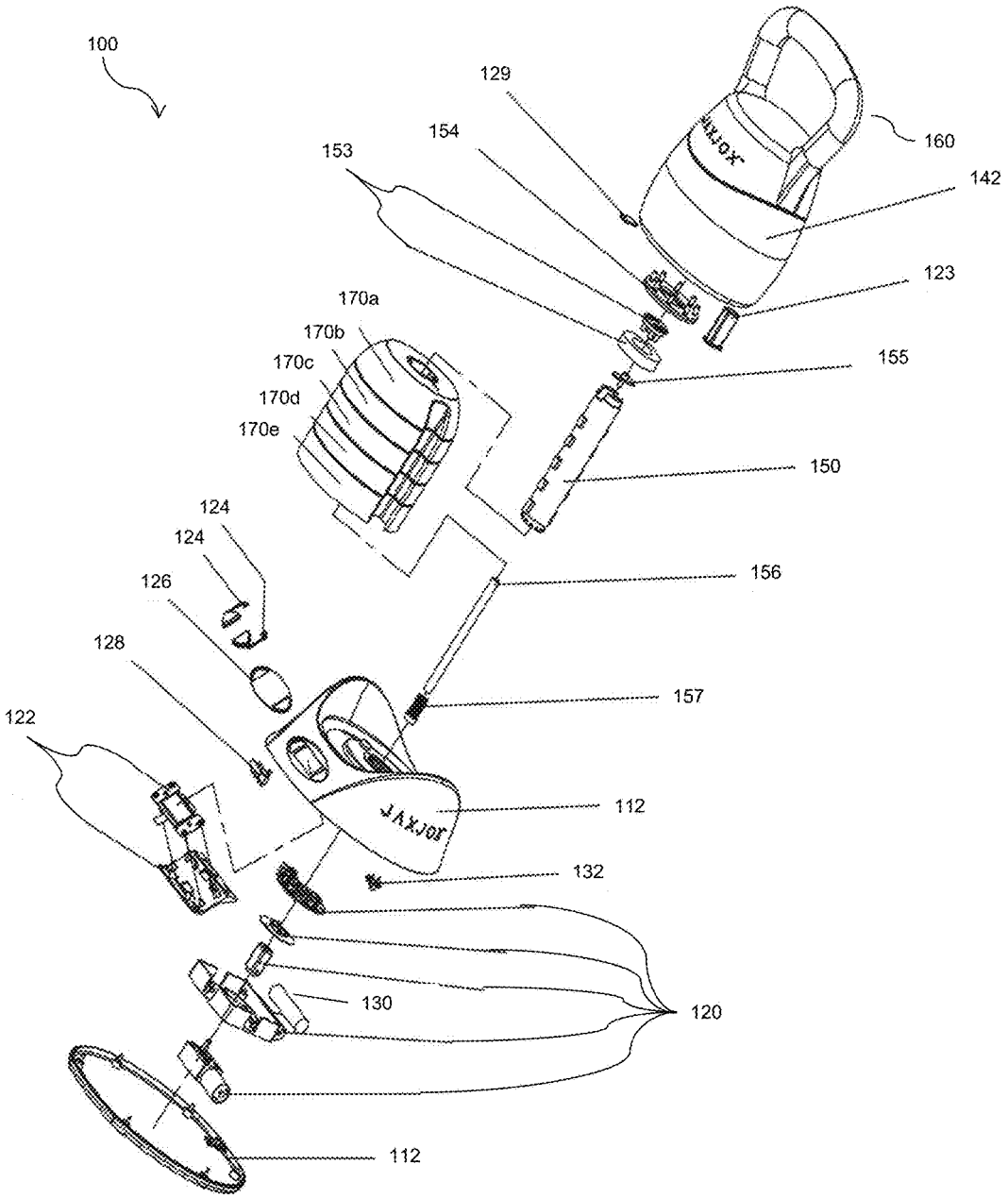
Figure 3A:
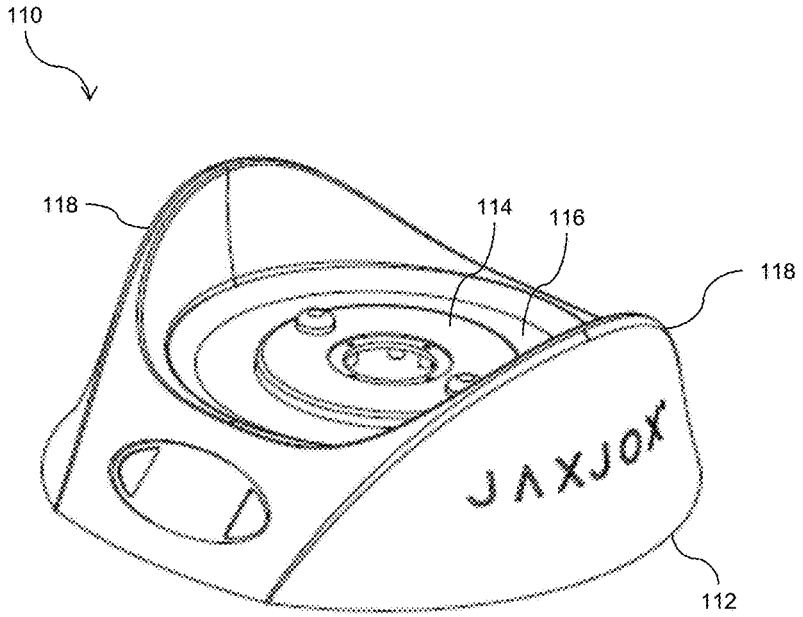
FIGS. 3A and 3B depict an exemplary base assembly of the exercise device of FIGS. 1A-1C.
Figure 3B:
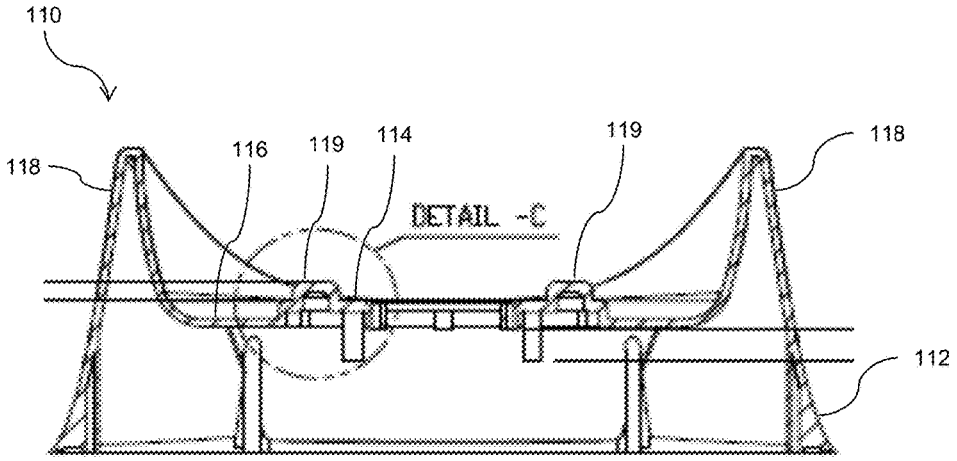
Figure 4A:
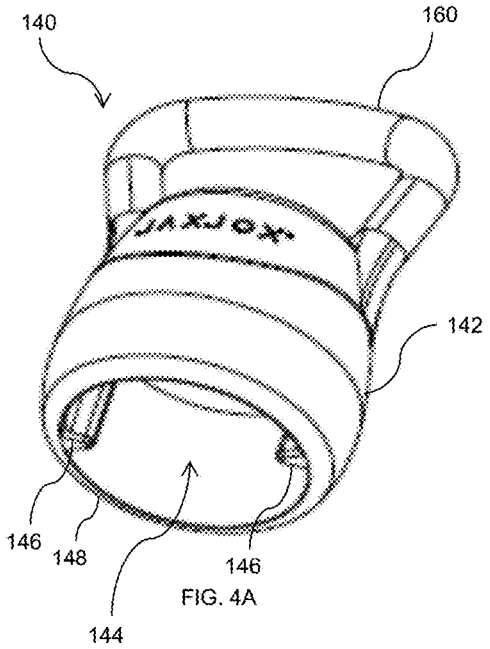
FIGS. 4A-4C depict an exemplary shell of the exercise device of FIGS. 1A-1C.
Figure 4B:
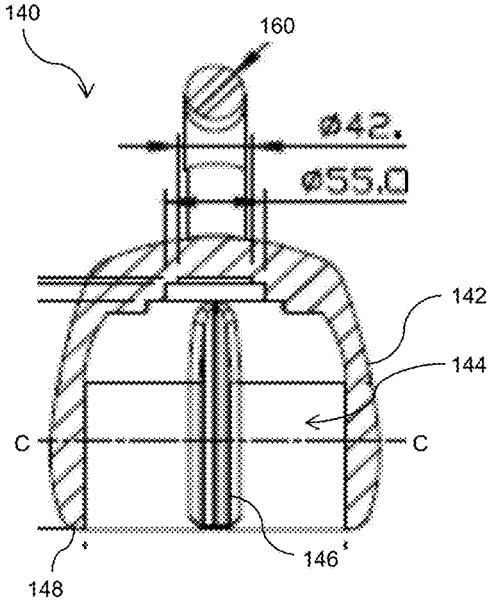
Figure 4C:
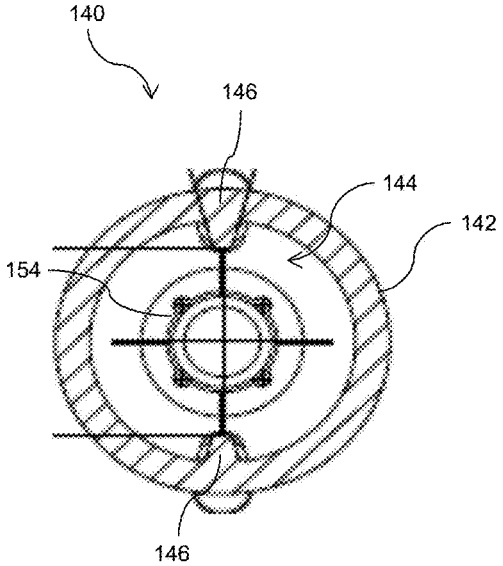
Figure 5A:
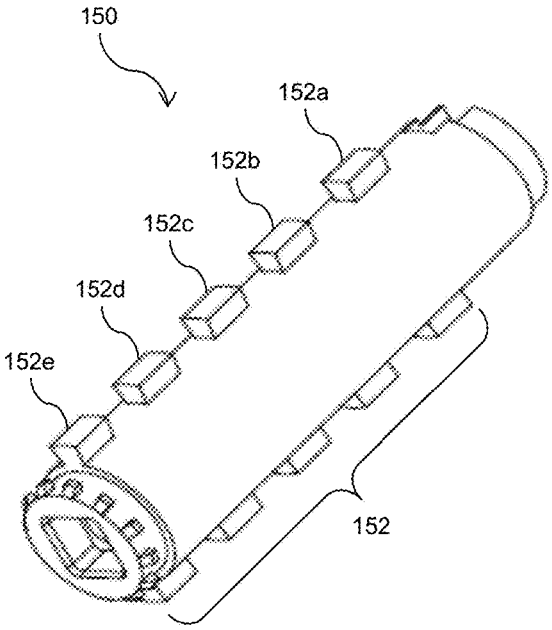
FIGS. 5A and 5B depict an exemplary shaft of the exercise device of FIGS. 1A-1C.
Figure 5B:
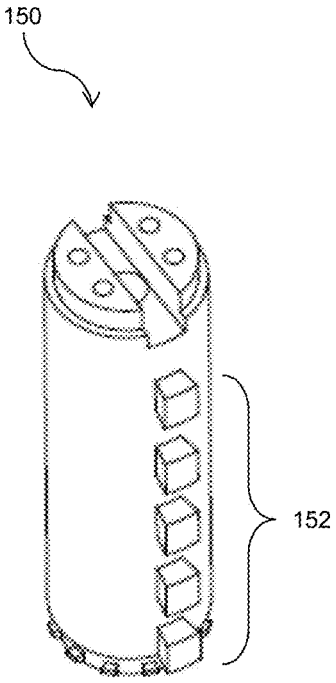

At the upper end of shaft 150, shell assembly 140 may further include one or more bearings 153 to enable rotation of shaft 150 relative to shell 142. Bearings 153 are coupled to shell assembly 150 by an upper fixed plate 154, and are coupled to shaft 150 by a fixed positional plate 155, as shown in FIG. 2B. At the lower end of shaft 150, shaft 150 is configured to be coupled to driver 120 by way of a linkage including a connecting rod 156 and a fixed block 157 having a spring, as shown in FIG. 2B.

Shell assembly 140 may further comprise a handle 160 positioned to be grasped by the user during the weight training exercise. As shown in FIGS. 2A, 2B, and 4A-4C, handle 160 is coupled to the exterior of shell 142. Handle 160 is provided at the apex of shell assembly 140, at a location of shell 142 opposite the coupling of shaft 150 to shell 142. Handle 160 is oriented orthogonally relative to shaft 150. However, it will be understood that, based on the type of weight training which is desired to be performed with exercise device 100, handle 160 may have a different orientation or an adjustable orientation, e.g. a parallel or oblique orientation, relative to shaft 150.

Weights 170 are selectively coupled to shell assembly 140 to enable performance of adjustable weight training exercises. As shown in FIGS. 2A and 2B, weights 170 are configured to be positioned adjacent one another, e.g., in a stacked orientation. In this orientation, all weights 170 are capable of fitting in the interior space 144 of shell 142. Thus, shell 142 is capable of being positioned overtop weights 170, and a lower edge 148 of shell 142 may rest on a surface 116 of base assembly 110.

As shown in FIGS. 6A-10B, device 100 may include five weight 170*a*, 170*b*, 170*c*, 170*d*, and 170*e*. It will be understood, however, that the number of weights shown in the drawings is provided for the purpose of illustration, and is not intended to be limiting. Any number of weights may be provided based on the desired amount, degree, or level of adjustability of exercise device 100. For a non-limiting example, 2, 3, 4, 5, 6, 7, 8 or more weights 170 may be provided in device 100, and weights 170 may be provided in increments of 1, 2, 3, 4, 5, 10, or 20 pounds.

Each weight 170 has a respective opening 172. Where weights 170 have a circular cross-section, opening 172 may be provided at a center or central region of each weight. When weights 170 are positioned in a stacked orientation, openings 172 are aligned or overlap with one another, such that openings 172 define an aperture extending along an axis of the stacked weight 170 from the uppermost weight 170*a* to the lowermost weight 170*e*.

Figure 6A:
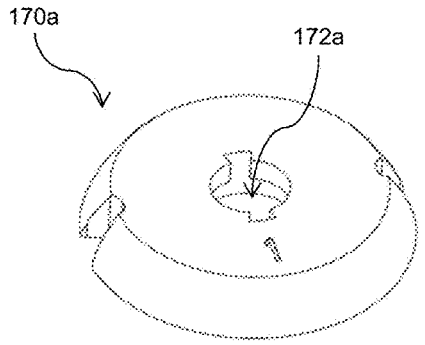
FIGS. 6A, 6B, 7A, 7B, 8A, 8B, 9A, 9B, 10A, and 10B depict exemplary weights of the exercise device of FIGS. 1A-1C.
Figure 6B:
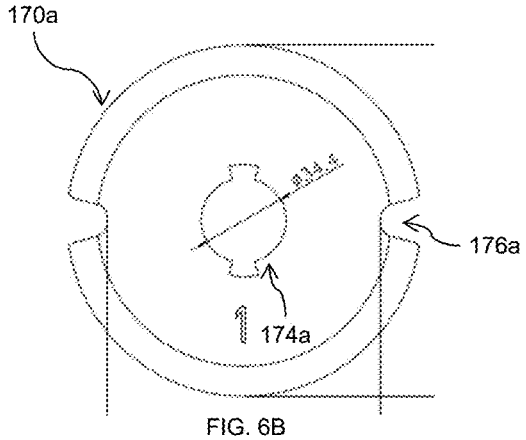
Figure 7A:
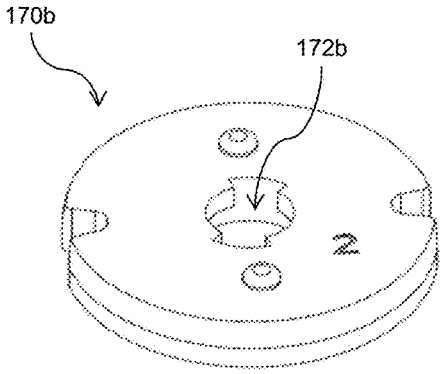
Figure 7B:
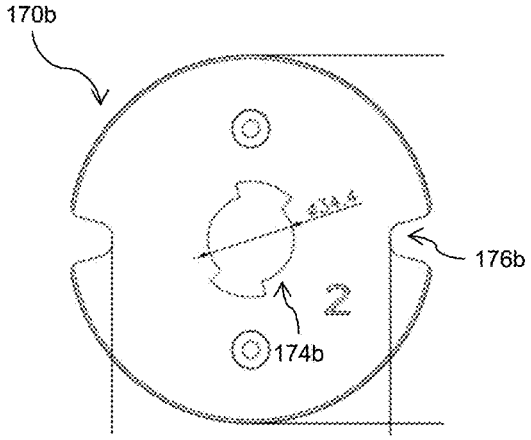
Figure 8A:
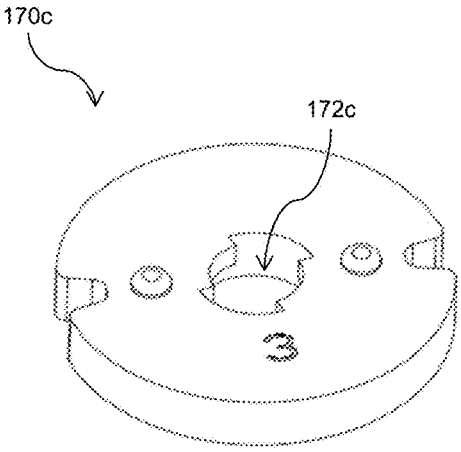
Figure 8B:
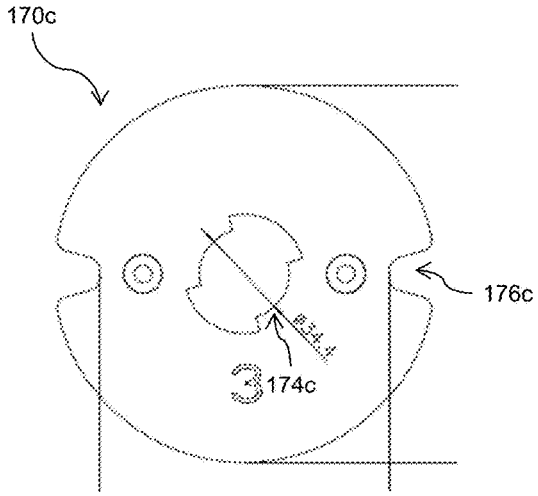
Figure 9A:
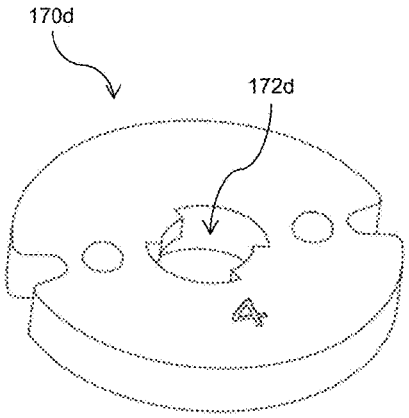
Figure 9B:
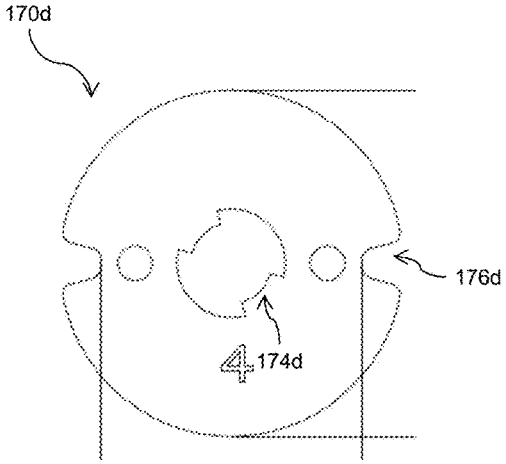
Figure 10A:
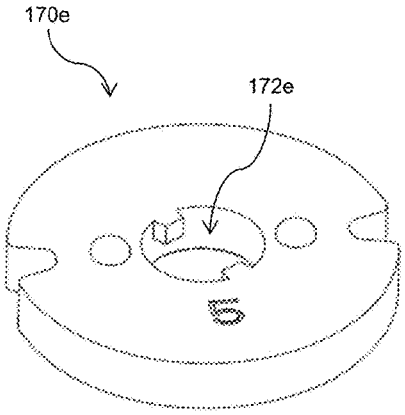
Figure 10B:
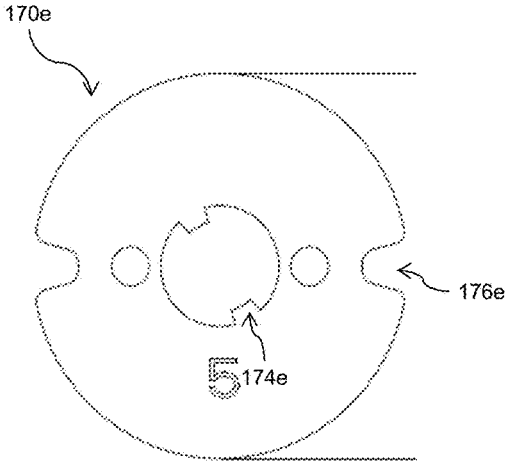

Each weight 170 has one or more ledges 174 extending into its respective opening. The circumferential width of a particular ledge 174 is dependent on where the respective weight is positioned in the stack of weights 170; the higher the weight 170 in the stack, the wider the ledge 174. As shown in FIG. 6A, ledge 174*a* has the largest width (covering nearly half of opening 172*a*), and ledge 174*e* has the smallest width (covering very little of opening 172*e*).

Each weight 170 may have one or more slots 176 on a periphery thereof. When weights 170 are positioned in a stacked orientation, slots 176 are aligned or overlap with one another, such that they may together slide along ridges 146 on the interior of shell 142.

An exemplary operation of exercise device 100 is described below in accordance with aspects of the present invention and with general reference to the embodiments of exercise device 100 illustrated in the figures.

Before the weight training exercise, weights 170 are provided in a stacked orientation on surface 114 of base assembly 110. In this position, the aperture defined by openings 172 extends from the upper surface of the uppermost weight 170*a* down through the remaining weight 170 to the region of driver 120.

Prior to performing a weight training exercise, the user places shell assembly 140 overtop the stacked weights 170. Alternatively, shell assembly 140 may already be positioned overtop weight 170, with the lower surface 148 of shell 142 supported on surface 116 of base assembly 110. In this position, shaft 150 extends through the aperture formed by openings 172, and can physically couple with driver 120.

When the user is ready to begin the exercise, the user may provide the appropriate input via input device 124. The input may comprise a selection of a type of weight training exercise, an amount of weight, or a number of weights 170. Responsive to receiving this input, driver 120 automatically moves shaft 150 to engage with a number of weights 170 corresponding to the user's input. Where base assembly 110 includes a controller 122, controller 122 controls driver 120 to rotate shaft to selectively couple shaft 150 with the appropriate number of weights 170. Controller 122 may be programmed to determine, or may have predetermined, the appropriate number of weights 170 corresponding to the user input, e.g. the type of weight training exercise or the amount of weight selected by the user. Where the user selects a number of weights, controller 122 may control driver 120 to rotate shaft 150 to couple with the selected number of weights 170.

Alternatively or in addition to input device 124, driver 120 may operate in response to the receipt of a communication by communication device 128. The user of exercise device 100 may wirelessly transmit a selection of a type of weight training exercise, an amount of weight, or a number of weights 170 to communication device 128 device 100, e.g., using the user's smartphone. Upon receipt of this data, controller 122 electrically controls driver 120 to rotate shaft 150 based on the data received from communication device 128.

Rotation of shaft 150 by driver 120 causes one or more of the projections 152 to selectively engage with corresponding ledges 174 on weight 170. The number of ledges 174 which are engaged by projection 152 is dependent on the rotational position of shaft 150. As such, driver 120 may control the number of weights 170 which are engaged with shaft 150 by controlling the rotational position of shaft 150. An example of such positioning is described below.

In a first rotational position of shaft 150, none of projections 152 underlie any of ledges 174. In this position, shaft 150 is freely movable through openings 172, e.g., to allow lifting of shell assembly 140 without any associated weights 170.

In a second rotational position of shaft 150, an uppermost projection 152*a* underlies ledge 174*a* of weight 170*a*, while the remaining projections 152 do not underlie any other ledges 174. In this position, shaft 150 engages with weight 170*a*, i.e., prevents axial movement of weight 170*a* relative to shaft 150, to allow lifting shell assembly 140 with weight 170*a* associated therewith.

In a third rotational position of shaft 150, an uppermost projection 152*a* underlies ledge 174*a* of weight 170*a*, and a next projection 152*b* underlies ledge 174*b* of weight 170*b*, while the remaining projections 152 do not underlie any other ledges 174. In this position, shaft 150 engages with weights 170*a* and 170*b*, i.e., prevents axial movement of weights 170*a* and 170*b* relative to shaft 150, to allow lifting shell assembly 140 with weights 170*a* and 170*b* associated therewith.

It will be understood that shaft 150 may be rotated into fourth, fifth, and sixth rotational positions, etc., to add engagement with weights 170*c*, 170*d*, and 170*e* in a similar fashion to that described above. Likewise, it will be understood that shaft 150 may be rotated to any number of rotational positions depending on the total number of weights 170 which are available to be engaged with shaft 150. For example, when exercise device 100 includes three total weights, shaft 150 may be rotatable to four different positions, whereas when exercise device 100 includes seven total weight, shaft 150 may be rotatable to eight different positions.

When shaft 150 is rotated to the correct rotational position, and the appropriate number of weights 170 are engaged with shaft 150, shaft 150 may be decoupled from driver 120 by lifting shell assembly 140 off of base assembly 110, e.g., by a user grasping handle 160 and lifting shell assembly 140. The user of exercise device 100 may then perform a desired weight training exercise with exercise device 100. Advantageously, decoupling shaft 150 from driver 120 removes the means for rotating shaft 150, and thereby prevents rotation of shaft 150, thereby preventing decoupling of the weights 170 from shaft 150 during the weight training exercise.

Figure 11:
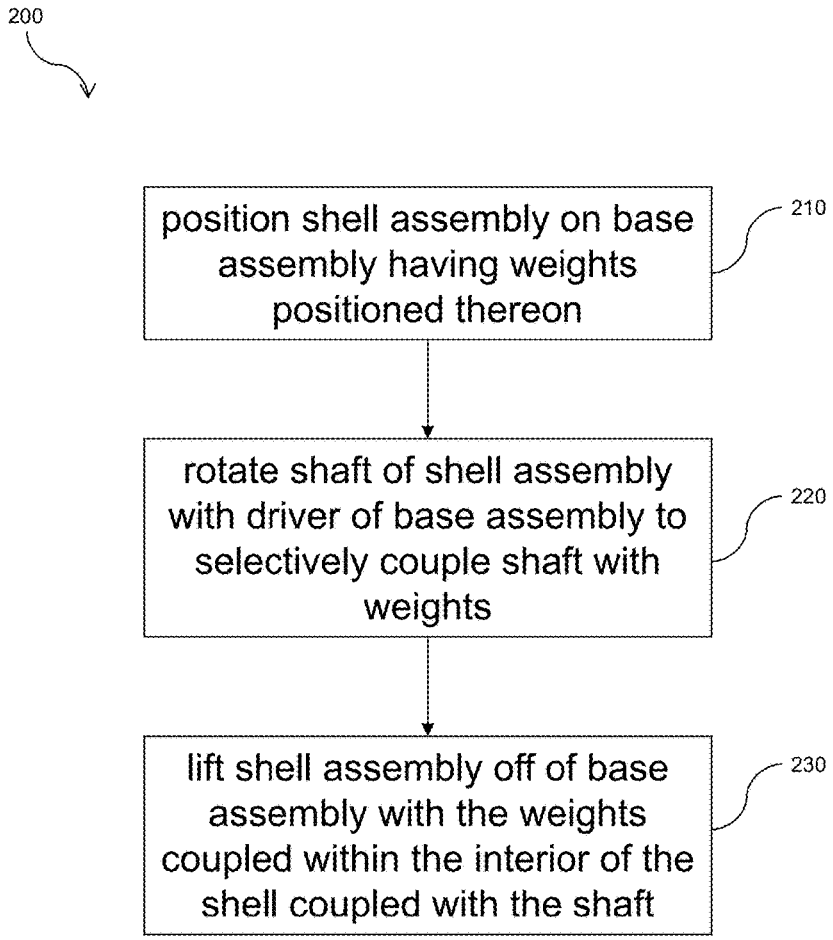
FIG. 11 depicts an exemplary exercise method in accordance with aspects of the present invention.

FIG. 11 illustrates an exemplary exercise method 200 in accordance with aspects of the present invention. As a general overview, method 200 includes positioning a shell assembly, rotating a shaft to selectively couple the shaft with one or more weight, and lifting the shell assembly. Additional details of method 200 are described below with respect to the component of device 100.

In step 210, a shell assembly is positioned on a base assembly having a plurality of weights positioned thereon. In an exemplary embodiment, shell assembly 140 is positioned on surface 116 of base assembly 110 overtop weights 170, such that weights 170 are received within interior space 144 of shell 142 of shell assembly 140. When shell assembly 140 is positioned overtop weights 170, shaft 150 is positioned within the defined by opening 172 in weights 170.

In step 220, a shaft of the shell assembly is rotated to selectively couple the shaft with one or more of the plurality of weights. In an exemplary embodiment, shaft 150 is rotated relative to shell 142 and weights 170. Shaft 150 is rotated by driver 120 of base assembly 110. Driver 120 rotates shaft 150 based on input provided by the individual performing the exercise to the input device 124, which is then communicated to controller 122. Rotation of shaft 150 by driver 120 causes shaft 150 to selectively engage with a desired number of weights 170, e.g., a number selected by an individual performing exercise method 200. In a further embodiment, this engagement include rotating shaft 150 to cause projections 152 on shaft 150 to engage with (e.g., underlie) respective ledges 174 of the desired number of weights 170, to prevent movement of the desired number of weights 170 along the axis of shaft 150.

In step 230, the shell assembly is lifted. In an exemplary embodiment, shell assembly 140 is lifted off of base assembly 110 by the individual performing exercise method 200. The individual may lift shell assembly 140 my grasping handle 160 of shell assembly 140. Shell assembly 140 is lifted with the weights 170 which are coupled with shaft 150 being held in the interior space 144 of shell 142. Engagement between projections 152 on shaft 150 and ledges 174 on weight 170 prevents decoupling of the weight 170 from shaft 150 when shell assembly 140 is lifted off of base assembly 110.

Figure 12:
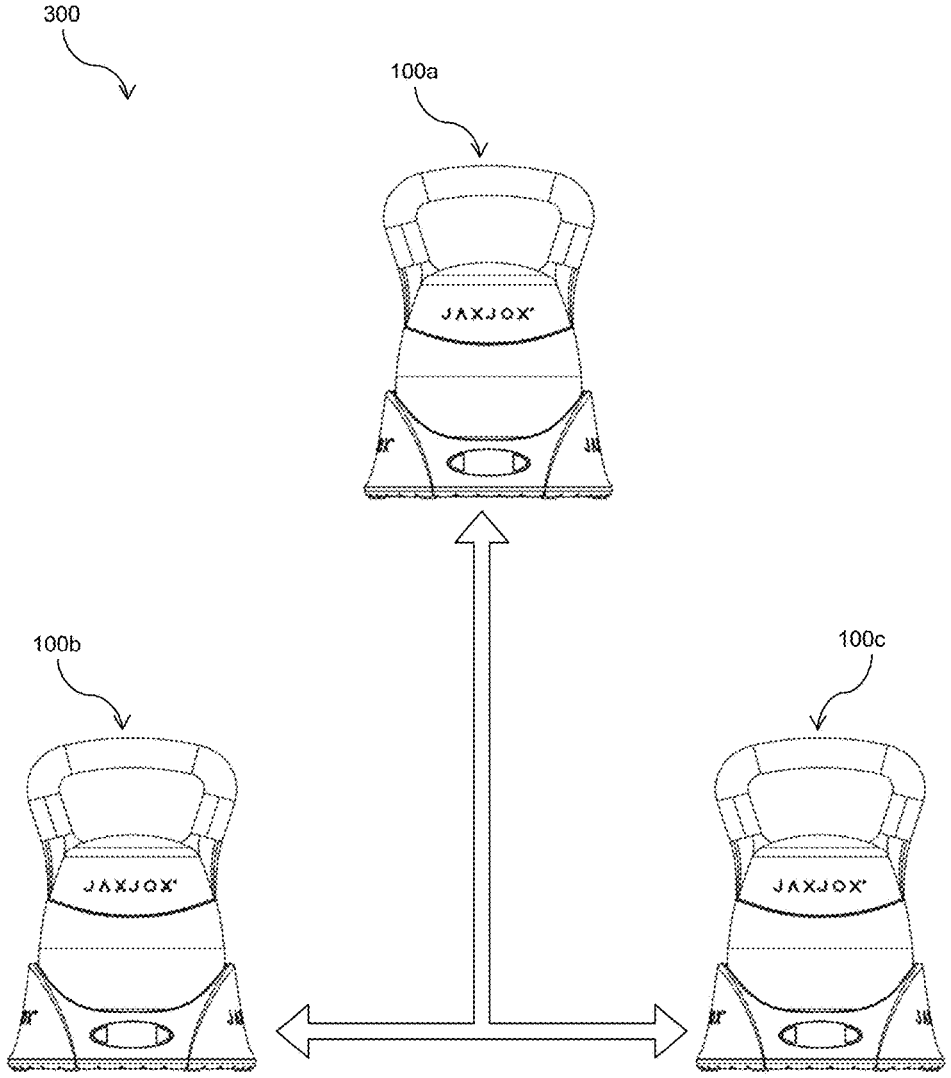
FIG. 12 depicts an exemplary exercise system in accordance with aspects of the present invention.

FIG. 12 illustrates an exemplary exercise system 300 in accordance with aspects of the present invention. As a general overview, system 300 includes a plurality of exercise devices 100. Additional details of system 300 are described below with reference to the components of exercise device 100.

As set forth above, exercise device 100 comprises a base assembly 110. In system 300, each exercise device 100 may comprise a respective base assembly 110. Alternatively, system 300 may comprise one or more combined base assemblies configured to support multiple shell assemblies and weight stacks. Such a combined base assembly may comprise subcomponents (e.g., input devices, displays, and communication devices) for each shell assembly supported by the combined base assembly, or may include a single subcomponent which is associated with each of the shell assemblies and weight stacks supported by the combined base assembly.

The driver 120 of each base assembly 110 of the exercise devices 100 (or the driver 120 of the combined base assembly) are configured to rotate respective shafts 150 based on data received via the associated communication device 128. In an exemplary embodiment, one of the exercise devices 100*a* (e.g., a master exercise device) receives an input from a user (e.g., via an input device 124) comprising a selection of a number of weight 170. The communication device 128 associated with the master exercise device 100*a* then transmits the input from the user to the communication device(s) 128 of one or more of the other exercise devices 100*b*, 100*c* in system 300 (as indicated by arrow in FIG. 12). These other exercise devices 100*b* and 100*c* are configured to receive data from the communication device 128 of the master exercise device 100*a*, and operate driver 120 to rotate shaft 150 to engage the appropriate number of weights 170. In this manner, one user of exercise system 300 (e.g., a weight trainer) may control the weight selection for each of the other users of exercise system (e.g., students).

Figure 13:
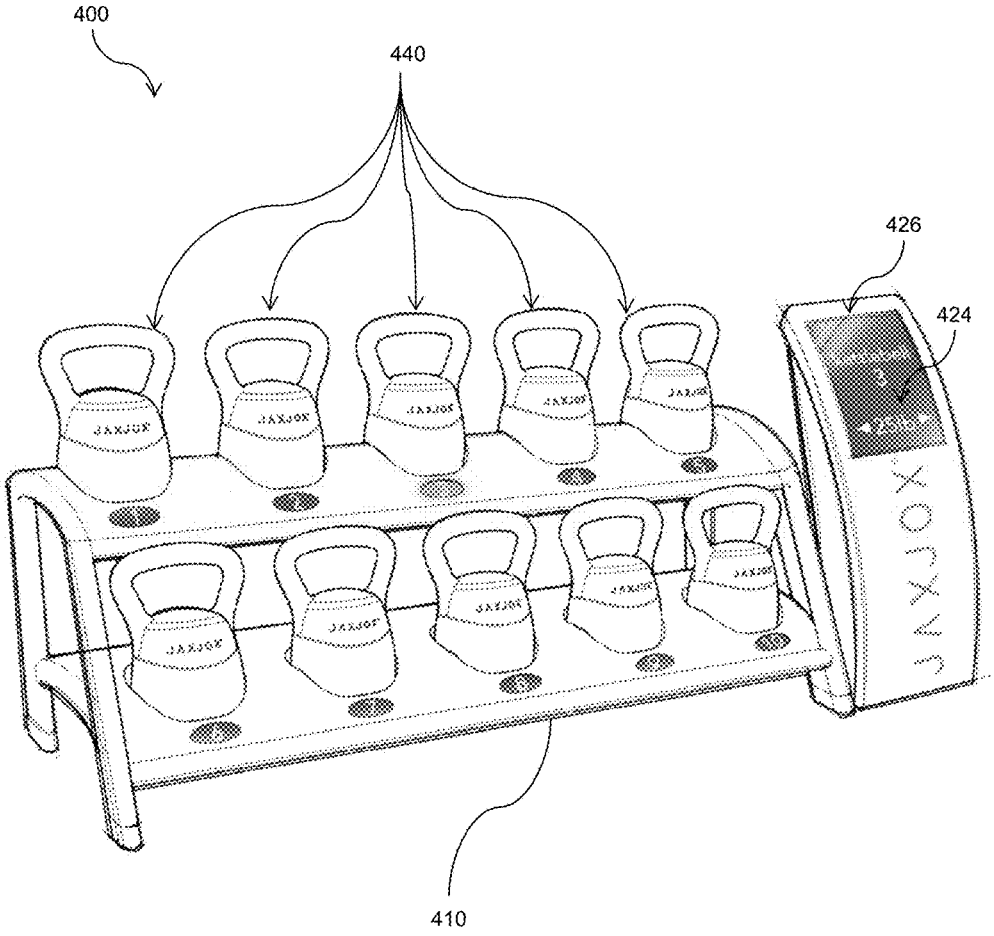
FIG. 13 depicts another exemplary exercise system in accordance with aspects of the present invention.

FIG. 13 illustrates another exemplary exercise system, exercise system 400, in accordance with aspects of the present invention. Generally, this invention also provides an exercise system comprising a plurality of exercise devices each having a plurality of weights configured to be positioned adjacent one another, each of the exercise devices being configured to engage a selected number of the plurality of weights. The exercise system also comprises at least one base assembly having a base configured to support the plurality of weights of at least one of the exercise devices, the base assembly being configured to be coupled to and decoupled from at least one of the exercise devices. The exercise system optionally includes an interface configured to communicate with one or more of the plurality of exercise devices. The base assembly is optionally configured to cooperate with one or more of the exercise devices, such as to increase or decrease the number of the weights engaged by one or more of the exercise devices, based on information received from or communicated to the interface.

As a general overview, system 400 includes a base assembly 410 and a plurality of shell assemblies 440. Base assembly 410 and shell assemblies 440 may include any of the components described above with respect to exercise device 100. Additional details of system 400 are described below.

Base assembly 410 provides support for the components of system 400, including each of the shell assemblies 440. Base assembly 410 is a combined base assembly, which may comprise subcomponents (e.g., drivers, input devices, controllers, communication devices, etc.) associated with each shell assembly 440 or groups of shell assemblies 440 supported by the combined base assembly, or may include a single subcomponent which is associated with each or all of the shell assemblies 440 and weight stacks supported by the combined base assembly 410.

Base assembly 410 houses a driver for each of the shell assemblies 440 supported on base assembly 410. Each driver is configured to be coupled to and decoupled from a respective shaft of each shell assembly 440, as described above with respect to exercise device 100.

Base assembly 410 may further comprise one or more controllers. Base assembly 410 may comprise a plurality of controllers, e.g., one controller for each driver or for each group of drivers, or may comprise a single master controller which electrically controls all drivers.

System 400 may further comprise a user interface such as an input device 424. Input device 424 receives input from a user of exercise system 400. Input device 424 may be operable to select a number of weights for any of the shell assemblies 440 of system 400, as described above with respect to exercise device 100. Input device 424 may enable the same weight to be input for all shell assemblies 440, or may allow the weight of each shell assembly 440 to be individually set.

The form of input device 424 is not intended to be limited. As shown in FIG. 13, input device 424 may be formed separately from base assembly 410, and communicate with the controller(s) in base assembly 410 by wire or wirelessly. Alternatively, input device 424 may be integrated into one structure with base assembly 410. A single input device 424 may be provided for all shell assemblies 440, or an input device 424 may be provided for each shell assembly 440. Structures for use as input device 424 will be known from the description herein.

As shown in FIG. 13, input device 424 may be integrated with a display 426. Display 426 is configured to display the input provided by the user to input device 424, e.g., the selected exercise, amount of weight, or a selected number of weights. As with input device 424, a single display 426 may be provided for all shell assemblies 440, or a display 426 may be provided for each shell assembly 440 or groups or subgroups of shell assemblies 440. Suitable displays for use as display 426 will be known from the description herein.

Shell assemblies 440 are grasped and lifted by users of system 400. Each shell assembly 440 includes a shaft which may be selectively coupled with one or more weights housed in the interior of respective shell assemblies 440, as described above with respect to exercise device 100.

Accordingly, a multi-stand embodiment such as the exercise system illustrated in FIG. 13 has the ability to display multiple exercise devices, such as kettlebells for example, on one stand and will either have one main display that controls all of the exercise devices or multiple displays with each display controlling an adjacent exercise device. The weight of each exercise device can either be the same or different weight per each device. For example, and for purposes of illustration, the top half of the exercise devices (on the top rack illustrated in FIG. 13) could each hold a maximum of 42 lbs, and the bottom half could have a maximum weight of 90 lbs. Other weights and combinations of weight variations are also contemplated.

The exercise devices and systems according to this invention are optionally provided with a wide range of ornamental shapes and designs and contours, depending on factors such as consumer preferences, aesthetic considerations, source identification, etc. Various ornamental designs can therefore be selected independent of the functionality described herein. For example, and for purposes of illustration, exemplary ornamental features of the exercise device are shown in co-pending U.S. Design Patent Application Ser. No. 29/655,801, filed Feb. 2, 2018, the disclosure of which is incorporated herein by reference.

While preferred embodiments of the invention have been shown and described herein, it will be understood that such embodiments are provided by way of example only. Numerous variations, changes and substitutions will occur to those skilled in the art without departing from the spirit or principle of the invention. Accordingly, it is intended that the appended claims cover all such variations as fall within the spirit, scope, or principle of the invention.

What is claimed:

1. An exercise device comprising:

a plurality of weights configured to be positioned adjacent one another;

a shell assembly having a shell defining an interior sized to receive the plurality of weights, the shell assembly also having a shaft coupled for rotation relative to the shell and extending within the interior of the shell, wherein when the plurality of weights are received within the interior of the shell, rotation of the shaft relative to the shell selectively couples the shaft with one or more of the plurality of weights; and a base assembly having a base configured to support the plurality of weights and the shell assembly, the base assembly also having a driver configured to be coupled to the shaft of the shell assembly when the shell assembly is supported by the base, the driver also being configured to be decoupled from the shaft of the shell assembly when the shell assembly is not supported by the base;

wherein the driver of the base assembly is configured to rotate the shaft of the shell assembly relative to the shell of the shell assembly when the driver is coupled to the shaft of the shell assembly to selectively couple the shaft with the one or more of the plurality of weights; and wherein the shell assembly further comprises a handle coupled to the shell and positioned to be grasped by a user of the exercise device, the handle oriented orthogonally relative to the shaft.

2. The exercise device of claim 1, wherein each of the plurality of weights has an opening, the openings of the plurality of weights at least in part defining an aperture extending along an axis when the plurality of weights are adjacent one another.

3. The exercise device of claim 2, wherein the shaft of the shell assembly is positionable within the aperture defined by the plurality of weights.

4. The exercise device of claim 3, wherein each of the plurality of weights includes one or more ledges extending into its respective opening.

5. The exercise device of claim 4, wherein the shaft includes a plurality of projections, wherein rotation of the shaft relative to the shell by the driver causes one or more of the plurality of projections of the shaft to selectively engage with respective ones of the one or more ledges of the one or more of the plurality of weights to prevent movement of the one or more of the plurality of weights along the axis of the aperture.

6. The exercise device of claim 1, wherein the base comprises a first surface configured to support the plurality of weights in a stacked orientation, and a second surface surrounding the first surface configured to support a lower surface of the shell of the shell assembly.

7. The exercise device of claim 1, wherein the driver comprises a motor, and the base assembly further comprises a controller that electrically controls the motor to rotate the shaft based on an input from the user of the exercise device.

8. The exercise device of claim 1, wherein the base assembly further comprises an input device which is electrically or mechanically coupled to the driver to cause the driver to rotate the shaft based on input from the user of the exercise device.

9. The exercise device of claim 1, wherein decoupling of the shaft of the shell assembly from the driver of the base assembly prevents rotation of the shaft relative to the shell, thereby preventing decoupling of the one or more of the plurality of weights from the shaft of the exercise device.

10. The exercise device of claim 1, wherein the exercise device is selected from the group consisting of a kettlebell, a dumbbell, a barbell, a medicine ball, or a weight system.

11. An exercise method comprising:

positioning a shell assembly on a base assembly having a plurality of weights positioned thereon, such that the plurality of weights are received within an interior of a shell of the shell assembly;

rotating a shaft of the shell assembly relative to the shell with a driver of the base assembly coupled to the shaft to selectively couple the shaft with one or more of the plurality of weights; and lifting the shell assembly off of the base assembly, using a handle oriented orthogonally relative to the shaft, with the one or more of the plurality of weights coupled with the shaft of the shell assembly and with the one or more of the plurality of weights within the interior of the shell; wherein the driver comprises a motor, and the base assembly further comprises a controller that electrically controls the motor, and wherein the rotating step comprises providing input to the controller to control the motor to rotate the shaft.

12. The exercise method of claim 11, wherein each of the plurality of weights has an opening, the openings of the plurality of weights at least in part defining an aperture extending along an axis when the plurality of weights are in a stacked orientation, and wherein the positioning step comprises positioning the shaft of the shell assembly within the aperture defined by the plurality of weights.

13. The exercise method of claim 12, wherein each of the plurality of weights includes one or more ledges extending into its respective opening, the shaft includes a plurality of projections, and wherein the rotating step comprises rotating the shaft relative to the shell to cause one or more of the plurality of projections of the shaft to selectively engage with respective ones of the one or more ledges of one or more of the plurality of weights to prevent movement of the one or more of the plurality of weights along the axis of the aperture.

14. The exercise method of claim 11, wherein the handle is coupled to the shell, and wherein the lifting step comprises grasping the handle of the shell assembly.

15. The exercise method of claim 11, wherein the base assembly further comprises an input device which is electrically or mechanically coupled to the driver, and wherein the rotating step comprises receiving input with the input device and causing the driver to rotate the shaft based on the received input.

16. The exercise method of claim 11, further comprising preventing decoupling of one or more of the plurality of weights from the shaft of the exercise device when the shell assembly is lifted off of the base assembly.

17. An exercise device comprising:

a plurality of weights configured to be positioned adjacent one another;

a shaft configured to engage with one or more of the plurality of weights;

a base assembly having a driver configured to be coupled to and decoupled from the shaft; and an input device associated with the shaft or the base assembly, the input device being configured to receive an input from a user of the exercise device, the input comprising a selection of a number of the plurality of weights;

wherein the driver of the base assembly is configured to automatically move the shaft relative to the plurality of weights when the driver is coupled to the shaft and when the input is received by the input device to selectively engage the shaft with the selected number of the plurality of weights; and wherein the shaft is coupled to a handle oriented orthogonally relative to the shaft.

18. The exercise device of claim 17, wherein each of the plurality of weights has an opening, the openings of the plurality of weights at least in part defining an aperture extending along an axis when the plurality of weights are adjacent one another, the shaft positionable within the aperture.

19. The exercise device of claim 18, wherein each of the plurality of weights includes one or more ledges extending into its respective opening.

20. The exercise device of claim 19, wherein the shaft includes a plurality of projections, wherein movement of the shaft by the driver causes one or more of the plurality of projections of the shaft to selectively engage with respective ones of the one or more ledges of the selected number of the plurality of weights to prevent movement of the one or more of the plurality of weights along the axis of the aperture.

21. The exercise device of claim 17, wherein the base assembly further comprises a base configured to support the plurality of weights in a stacked orientation.

22. The exercise device of claim 17, wherein the driver comprises a motor, and the base assembly further comprises a controller that electrically controls the motor to rotate the shaft based on the input from the user of the exercise device.

23. The exercise device of claim 17, further comprising a display configured to display the selected number of the plurality of weights.

24. An exercise device comprising:

a plurality of weights configured to be positioned adjacent one another;

a shaft configured to engage with one or more of the plurality of weights;

a base assembly having a driver configured to be coupled to and decoupled from the shaft; and an input device associated with the shaft or the base assembly, the input device being configured to receive an input from a user of the exercise device, the input comprising a selection of a number of the plurality of weights;

wherein the driver of the base assembly is configured to automatically move the shaft relative to the plurality of weights when the driver is coupled to the shaft and when the input is received by the input device to selectively engage the shaft with the selected number of the plurality of weights;

further comprising a sensor associated with the base or the shaft, the sensor being configured to detect when the driver is coupled to or decoupled from the shaft.

25. An exercise system comprising:

a plurality of exercise devices according to claim 24, each of the plurality of exercise devices further having a communication device configured to wirelessly communicate with the communication device of another one of the plurality of exercise devices, wherein the driver of one of the plurality of exercise devices is configured to rotate the shaft of the one of the plurality of exercise devices based on data received from the communication device of another one of the plurality of exercise devices.

26. The exercise system of claim 25, wherein the driver of the one of the plurality of exercise devices comprises a motor, and the base assembly of the one of the plurality of exercise devices further comprises a controller that electrically controls the motor to rotate the shaft of the one of the plurality of exercise devices based on data received from the communication device of the other one of the plurality of exercise devices.

27. The exercise system of claim 25, wherein the driver of the one of the plurality of exercise devices is further configured to rotate the shaft of the one of the plurality of exercise devices based on an input from the user of the exercise system, and is further configured to transmit the input from the user to the communication device of another one of the plurality of exercise devices.

28. The exercise system of claim 25, wherein the communication device is configured to wirelessly communicate the selected number of weights coupled to the shaft of one of the plurality of exercise devices to another one of the plurality of exercise devices.

29. The exercise device of claim 24, wherein the exercise device is selected from the group consisting of a kettlebell, a dumbbell, a barbell, a medicine ball, or a weight system.

* * * * *